United States Patent [19]

Lehmann et al.

[11] 4,191,010

[45] Mar. 4, 1980

[54] PROCESS AND DEVICE FOR PRODUCING FANCY YARN

[75] Inventors: Robert Lehmann, L'Arbresle; André Lyonnet, Lyons; Paul Rochas, St. Didier au Maur d'Or, all of France

[73] Assignees: Institut Textile de France; Agence Nationale de Valorisation de la Recherche, both of Boulogne sur Seine, France

[21] Appl. No.: 920,501

[22] Filed: Jun. 29, 1978

[30] Foreign Application Priority Data

Jul. 1, 1977 [FR] France ..... 77 21022

[51] Int. Cl.[2] ..... D02G 1/10; D02G 1/00

[52] U.S. Cl. ..... 57/208; 57/246; 57/351; 28/253; 28/260

[58] Field of Search ..... 57/140 R, 140 J, 34 HS, 57/157 MS, 157 TS, 91, 245-247, 282, 351, 208, 206; 28/252, 253, 260, 261

[56] References Cited

U.S. PATENT DOCUMENTS

| | | | |
|---|---|---|---|
| 3,047,932 | 8/1962 | Pittman et al. | 28/253 |
| 3,095,630 | 7/1963 | Pittman | 28/253 |
| 3,392,425 | 7/1968 | Kalwaites | 28/260 X |
| 3,426,407 | 2/1969 | Constantine | 28/260 |
| 3,874,156 | 4/1975 | Hamby | 57/140 R |

*Primary Examiner*—John Petrakes

*Attorney, Agent, or Firm*—Arnold, White & Durkee

[57] ABSTRACT

In order to produce a fancy yarn with protuberances along its length in a simple manner, and without adding either a binding yarn or an effect yarn, a multi-filament yarn of continuous filaments is forwarded by a positive drive means and twisted and taken up by a spindle. When engaged with a surface of the drive means the yarn is engaged by an edge which brakes some of the filaments.

22 Claims, 12 Drawing Figures

PROCESS AND DEVICE FOR PRODUCING FANCY YARN

DESCRIPTION

The present invention relates to a process and a device for producing a fancy yarn possessing protuberances along its length; it also relates to the new yarns thus obtained.

The invention relates, more particularly, to a process and device for producing, from a multi-filament yarn having continuous filaments, fancy yarns which possess stable protuberances over their length, these protuberances being either spaced out from one another and forming effects which are similar to flakes, knops, slubs and the like, or forming continuous effects which extend over the entire length of the yarn.

Fancy yarns can be produced by numerous techniques. As regards yarns which possess localised effects over their length, such as yarns with flakes or knops, the most widespread technique, which is described in U.S. Pat. Nos. 3,868,812 and 3,717,959 consists in winding at least one effect yarn around a core yarn, for example using a twister comprising several pairs of delivery rolls or a throwing frame with a hollow spindle, optionally equipped with a means for producing false twist.

By varying the feed rate of the effect yarn relative to that of the core yarn, and/or by varying the winding-up speed and/or by using a lapping needle, it is possible to obtain a wide variety of fancy yarns. However, this technique exhibits numerous disadvantages; the main disadvantages are a very low production speed and the need to use a binding yarn in order to obtain a fancy yarn possessing stable effects.

Furthermore, it is necessary to use special, and therefore expensive, equipment which sometimes lacks flexibility.

In order to increase production speeds, it has been proposed to combine the core and effect yarns by false twisting, optionally subjecting them to a heat treatment before and/or after them passing through the false twist device. A technique of this kind is described in French Pat. No. 2,196,408.

However, with this technique, it is virtually impossible to obtain blocked, stable effects over the length of the yarn unless a binding yarn is again used.

It has also been proposed to produce fancy yarns directly as chemical yarns are extruded or drawn, for example by carrying out non-uniform drawing. The yarns obtained are not satisfactory however because they exhibit variations in their properties over their length, especially as regards their strength and their dyeing affinity, and, in addition, the effects are not very pronounced.

It is also well-known to modify the properties (fullness, handle, bulk and elasticity) of multi-filament chemical yarns by subjecting them to a texturising treatment. In general terms, a treatment of this kind consists in creating a mechanical deformation of the yarn and heat-setting with this deformation. The mechanical deformation can be provided by means of a false twist spindle by passage between gears, by knitting, heat-setting and unravelling, by compression or by edge crimping.

These processes do not make it possible to obtain fancy yarns directly, within the meaning of the term as used in the present Specification; however, as stated previously, they make it possible to modify the fullness, elasticity and other properties of the treated yarn, it being possible, in general, for the elementary filaments of these yarns to be separated from one another after treatment.

Admittedly, it has been proposed to adapt these processes for the production of fancy yarns, but in no case as it possible directly to obtain a fancy yarn which possesses blocked protuberances over its length.

U.S. Pat. No. 3,136,111 to E. H. PITTMAN describes the production of a yarn which possesses, over its length, portions having different characteristics. According to this Patent, which describes a variant of the edge crimping process the yarn is passed over a sharp edge which brings about a dissymmetric modification of the structure of each filament forming the yarn, causes each of these filaments to crimp and, consequently, leads to an increase in the bulk and the extensibility of the treated yarn. In order to obtain a yarn which possesses, along its length, successive portions of high and low elasticity and high and low fullness, the yarn is intermittently placed in contact with a heating plate, prior to its passage over the edge which brings about the modification in the structure of the filaments. A technique of this kind does not make it possible to obtain fancy yarns which possess stable protuberances over their length; but, it does make it possible to obtain a texturised yarn comprising successive zones having different characteristics.

U.S. Pat. No. 3,357,171 to P. F. MARSHALL also describes a technique which makes it possible to obtain a fancy yarn possessing protuberances over its length. According to this Patent, a composite yarn is formed which comprises at least one core yarn with one yarn wound around it, and the protuberances are produced by pressing the wound yarn down around the core, the latter thus acting as a support. However, with this technique, it is not possible to obtain a fancy yarn from a single starting yarn and, furthermore, the protuberances formed are not stable and must be blocked by means of an auxiliary yarn.

According to one aspect of the present invention there is provided a process for the production of a fancy yarn having stable protuberances along its length, wherein at least one multi-filament yarn of continuous filaments which is essentially free from twist is delivered by means of a positive delivery device and then twisted and taken up by means of a spindle, and wherein, without varying the feed rate and the take-up speed of the yarn, some of the filaments of the multi-filament yarn are temporarily braked by means of an edge acting on the yarn at a position where the yarn is in contact with a surface of the delivery device, the twist imparted by the spindle extending back to the zone in which the edge acts on the yarn.

According to another aspect of the present invention there is provided a device for production of a fancy yarn having stable protuberances along its length from one or more multi-filament yarns of continuous filaments, such device including at the or each of one or more working stations, at least one positive yarn delivery device and a spindle for twisting and taking up the yarn arranged downstream from the delivery device, and an edge for temporarily braking some of the filaments, the edge being positioned to act on the yarn whilst the yarn is in contact with a surface of the delivery device, such that in use the twist imparted by the spindle extends back to the zone in which the edge acts on the yarn.

The invention also provides yarns made by such a process or using such apparatus. With the present invention, fancy yarns which possess stable and blocked protuberances along their length, can be obtained directly from a single multi-filament yarn having continuous filaments, without adding either a binding yarn or an effect yarn. The protuberances can be more or less pronounced or short or long, as desired, and indeed can be continuous. The process according to the invention can be carried out on conventional equipment with minor conversion.

It has been found that, when they possess protuberances which are spaced apart, the yarns obtained by this process are easy to work, especially to knit and to weave, and this can be explained by the special form of the protuberances produced on the yarn, these protuberances possessing thinned ends, which facilitates the passage of the said protuberances into guides in the knitting or weaving devices.

The invention can be carried out using as starting material any multi-filament yarn having continuous filaments, which is virtually free from twist. The term "virtually free from twist" is to be understood, in terms of the present invention, as meaning a yarn which possesses zero twist, or essentially zero twist such as that imparted during its manufacture (for example of the order of 10 to 30 turns per meter).

Prior to being treated according to the invention, yarn can if desired be subjected to a conventional texturising treatment, for example a false twist treatment, which may or may not be set-in, provided, however, that this treatment does not impart twist to the yarn.

Furthermore, in cases where a continuous multi-filament yarn, which has been texturised beforehand by false twisting, is used as the starting yarn, it has been found that, surprisingly, after treatment according to the invention, the fancy yarn obtained no longer possesses residual twist torque (torque effect) and, consequently, that is is not necessary to combine it with another yarn or to set it in when it is used.

In the process of the invention, the action of the edge has the effect of creating an accumulation of strands which are trapped against one another due to the twist, thus creating the desired effect.

It is possible to vary the amplitude of the effects produced, the interval between them and their bulk by modifying the duration and/or frequency of application of the edge and/or the pressure of the edge on the treated yarn.

Likewise, although the braking on the filaments by the edge can, as stated above, be carried out intermittently, it is possible for the edge to act permanently on the yarn by blocking some of the filaments. In this case, the protuberances formed on the yarn form a continuous effect which extends over the length of the yarn. Finally, the action of the edge on the yarn at a position before the yarn leaves the surface of the delivery device, is preferably carried out essentially perpendicular to the surface of the said delivery device, the path of the yarn downstream from the edge also preferably being perpendicular to the plane of action of the edge.

The process according to the invention can be carried out by means of a device which also forms part of the invention.

Devices according to the invention can have a plurality of working stations, and will generally be equipped with, in each station, a feed source of multi-filament yarn having continuous filaments.

Advantageously, the device of the invention includes, between the feed source of the yarn to be treated and upstream of the yarn delivery device, means to place the feed yarn under tension, for example a second delivery device or any other equivalent means such as a bar which can be raised or lowered.

In one embodiment of the invention, the means for temporarily braking some of the filaments is a sharp edge which is flexible in the direction of travel of the yarn and is driven by a reciprocating movement which brings it alternately into and out of contact with the surface of the dlivery device. The sharp edge can be, for example, the edge of a flexible blade mounted on a rigid support driven to have a reciprocating movement, this blade being similar to a razor blade. Alternatively, the sharp edge could be produced on a rigid blade mounted on a support which provides flexibility in the direction of travel of the yarn and is also driven with a reciprocating movement to bring the said edge into contact with the yarn in order to produce the protuberances.

In other embodiments, the edge can be a generatrix of a bar of circular cross-section. Alternatively, a bar with a cross-sectional shape other than circular, for example rectangular or triangular can be employed, and the edge acting on the yarn, before the yarn leaves the surface of the delivery device with which it is in contact, can be either an edge of the bar or one of its faces.

Although the edge for braking some of the filaments is generally arranged perpendicular to the direction of movement of the yarn, it can, in certain cases, be arranged obliquely relative to this movement.

Any hard, non-deformable, wear-resistant material, for example metal, ceramic or the like, can be used as the material which forms the element providing an edge.

Although, in the embodiments described above, the edge for braking some of the filaments is brought intermittently into contact with the yarn, with a frequency, duration and pressure which can be adjusted depending on the desired effect, it is also possible, to hold the edge permanently against the yarn. In this case, a yarn is obtained which possesses a continuous protuberance over its entire length.

Furthermore, when producing effects which are spaced out along the length of the yarn, this is preferably achieved by an alternating movement of the edge to bring it into contact with the yarn; however, quite obviously, it is also possible to operate in a converse manner, that is to say by leaving the edge fixed and then alternately moving the yarn delivery device.

In addition, the process according to the invention is preferably carried out by using, as the yarn delivery device, a delivery device having a surface which, in the region where the edge acts on the yarn, has a flexible coating, the condition of the surface allowing some filaments to be carried along without being affected by the edge and the other filaments to be temporarily braked as a result of the action of the edge.

Advantageously, a belt-type delivery device will be used as the positive delivery device, that is to say a delivery device essentially comprising a metal drive shaft, in contact with which there is a belt supported by two guide-rollers, the said rollers being slightly set apart from the drive shaft, and a yarn being defined between the belt and the drive shaft. In this case, the temporary braking of some of the filaments will be carried out adjacent the point where the yarn leaves the belt of the delivery device and passes towards the twisting spindle.

Alternatively, a roller-type delivery device, that is to say a delivery device essentially comprising a metal drive cylinder and a pressure cylinder, for example made of rubber, could be used as the delivery device, the edge then acting on the yarn adjacent the point where the yarn leaves the surface of the pressure cylinder.

It is desirable that the yarn should be engaged with and transported by the belt of the delivery device, or by the surface of the roller, upstream from the braking edge. In fact, when the edge is applied against the delivery device, the belt or the roller pushes the filaments into contact with the edge, which produces an effect of compression and accumulation, whereas, when the braking device leaves the surface, the surface prevents the twist, imparted downstream, from extending back upstream and therefore makes it possible to keep the yarn essentially free from twist prior to the action of the edge.

Of course, other types of delivery device, as described in Belgian Pat. No. 656,220, can be used, preferably those in which the surface in the region of action of the edge on the yarn consits of a flexible coating so that it is possible for some filaments of the yarn to be carried along, despite the action of the edge.

Furthermore, the spindle for yarn wind-up and twist is preferably a spindle of the ring and traveller type. One type of spindle which is particularly suitable is that used for so-called "carded wool type" spinning and known as a pointed-head spindle, that is to say a spindle, the upper part of which possesses a device around which the yarn makes a few turns, this device making it possible to reduce both the balloon formed by the yarn and the winding-up tension. This type of spindle is used especially on the R.F.S. type machine of Messrs. SPINNBAU and is described in German Pat. No. 1,287,485. The device according to the invention can include guides for the yarn between the various stages, the important point being that, when a guiding device of this type is arranged between the positive delivery device associated with the edge and the winding-up twisting element, this device allows the twist to extend back to the region of the delivery device where the edge acts on the yarn.

As stated previously, any multi-filament yarn having continuous filaments, which may advantageously be texturised, for example by false twist, can be used as the material constituting the yarn which is to be treated by the process according to the invention. The only condition is that the treated yarn should be free from twist or should possess only a slight twist which, in practice, should not exceed 20 turns per meter.

The process according to the invention can also be carried out by feeding in parallel two or more multi-filament yarns having continuous filaments of the above-mentioned type, these two yarns being brought in parallel into the positive delivery device, and it being possible for these yarns to be of the same type or of different types.

Likewise, the positive delivery device can be fed with a multi-filament yarn having continuous filaments, which is virtually free from twist, as stated previously, and with an elastomeric yarn, which is brought into the delivery device under tension, this elastomeric yarn being covered, after treatment, with the multi-filament yarn possessing protuberances. This kind of procedure makes it possible to obtain elastic fancy yarns in a simple manner.

As already stated, it is possible to vary the size of the effects produced, their length and/or the interval between them, for example by modifying the duration of application of the edge to the yarn and/or the pressure of the edge on the yarn. In order to do this, it suffices to use a mechanical, electrical, electro-mechanical or pneumatic permutation device. However, the pressure should always be adjusted so that part of the filaments which form the yarn should be temporarily braked by the edge acting on the yarn, before the yarn leaves the surface of the delivery device with which it is in contact, the twist imparted by the winding-up means extending back to the level of the zone of action of this edge.

Finally, although the invention is generally carried out using yarns originating from a feed source consisting, for example, of a rack carrying bobbins or a support for yarns coming from a spinning operation, it can also be carried out, if desired, directly on a spinning or texturising frame, which makes it possible to produce multi-filament yarns having continuous filaments.

The yarns obtained by carrying out the process according to the invention twisted and possesses, over its length, protuberances which are uniformly or non-uniformly spaced out and are formed by the disorientation and intertwining of the filaments constituting the yarn, the said protuberances also being twisted and being progressively joined to the uniform parts of the yarn, their ends being tapered.

When the temporary braking of some of the filaments is carried out by holding the edge permanently against the yarn, before the yarn leaves the surface of the delivery device, the effect obtained is similar but it takes the form of a single protuberance extending over the entire length of the yarn.

The invention will be better understood from the following description which is given by way of example only with reference to the accompanying drawings in which.

Figure 5:
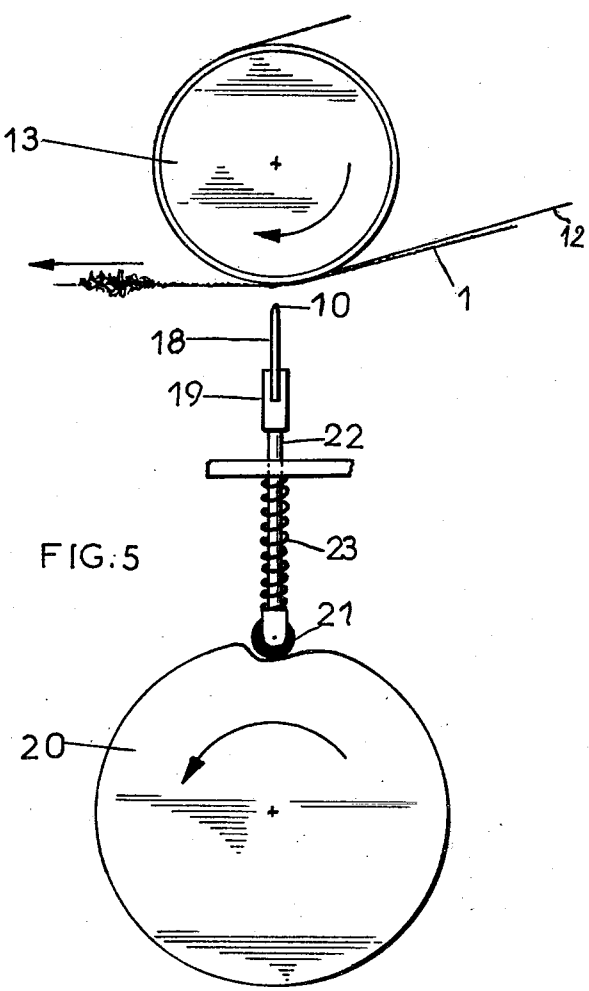
Figure 4:
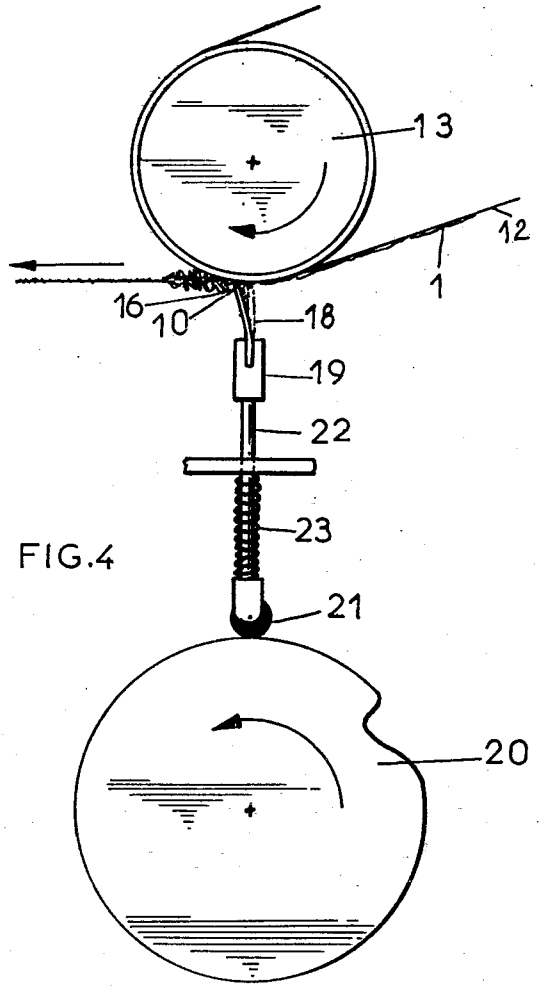
Figure 6:
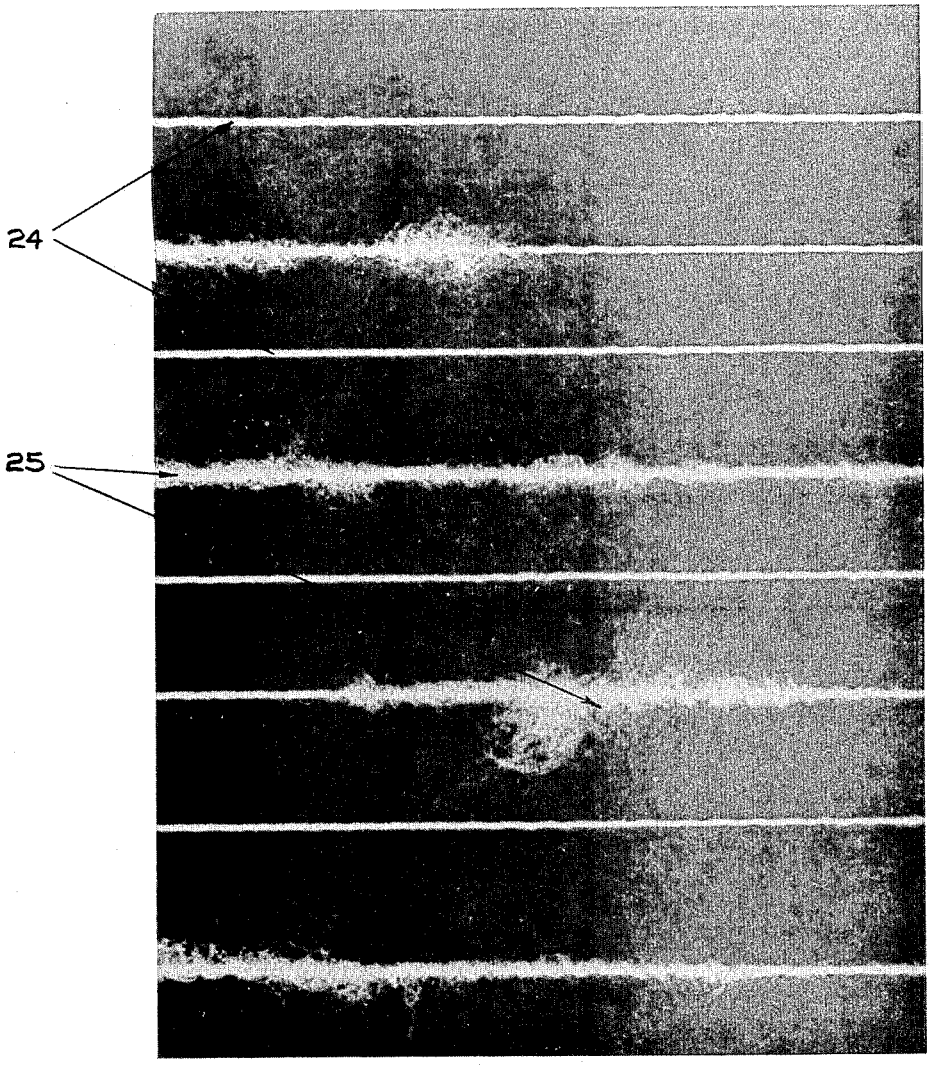
Figure 9:
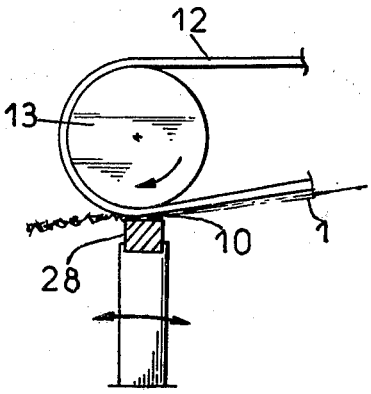
Figure 10:
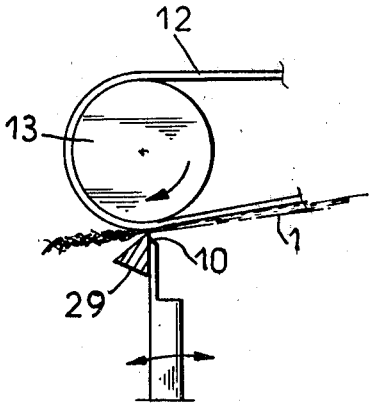
Figure 11:
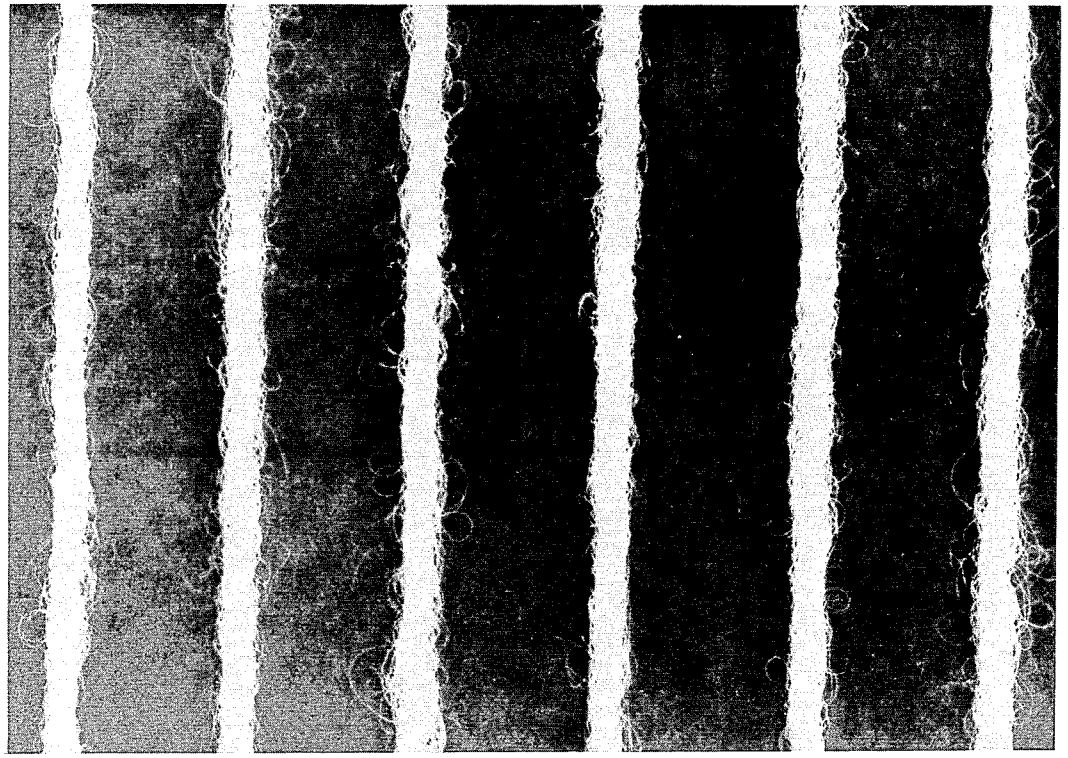
Figure 12:
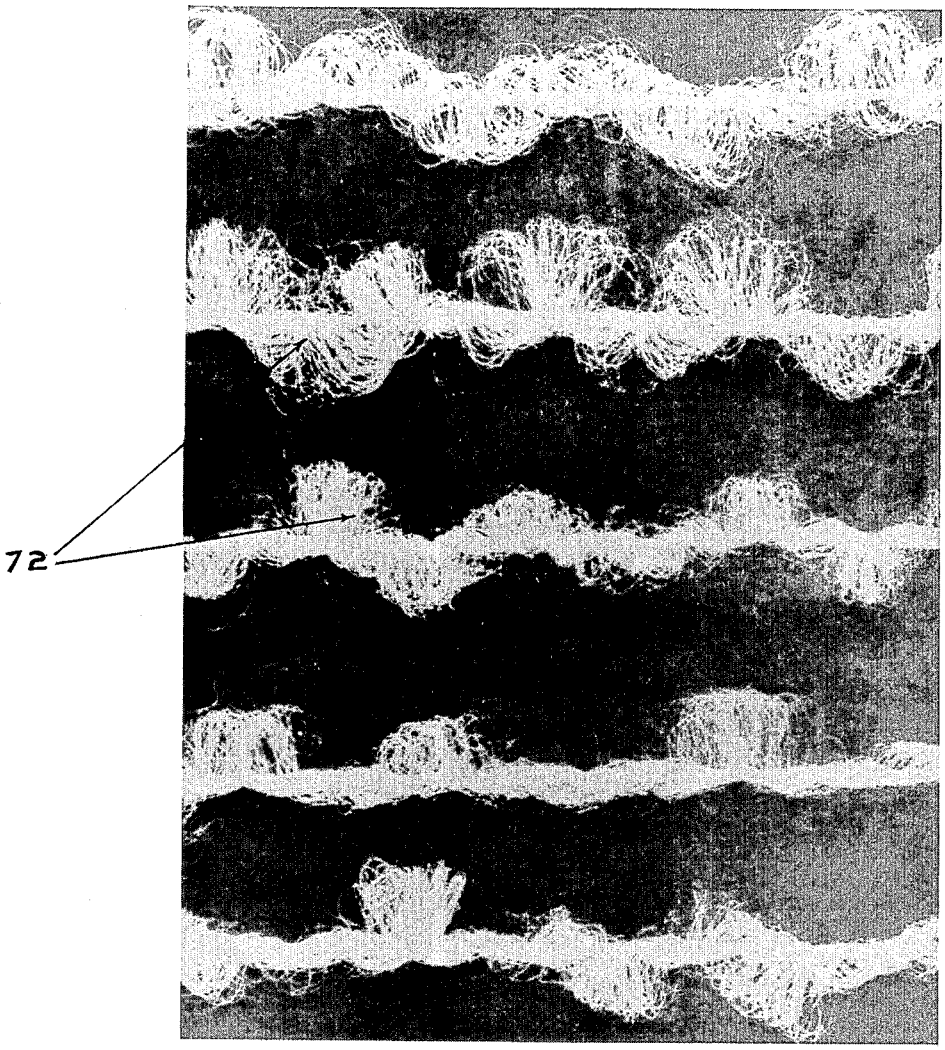

FIGS. 4 and 5 schematically illustrate a method of controlling the movements of the edge and also the action of the latter for the formation of the effect;

FIG. 6 is a reproduction of an enlarged photograph of a yarn produced, according to the invention, by intermittent action of the edge;

FIGS. 7, 8, 9 and 10 illustrate various forms of braking elements which possess edges, of various shapes, for use in carrying out the invention; and FIGS. 11 and 12 are reproductions of enlarged photographs of yarns produced, according to the invention, by permanent action of the edge on the yarn.

As illustrated in the attached figures, the invention is carried out in the following manner.

A yarn 1, originating from a feed source 2, is forwarded by means of a positive delivery device 3 which delivers it positively to a winding-up system 5 which both takes up and twists the yarn. The take-up of the yarn and the twist are provided by means of a spindle having a ring 6 and a traveller 7 and which has a pointed head 8. Between the feed source 2 and the delivery device 3, the yarn is placed under tension by an appropriate means 9, for example by means of a second delivery device having a speed which is slightly lower than that of the delivery device 3, or quite simply by means of a tensioning device or a bar which can be raised or lowered.

Some of the filaments forming the yarn are temporarily braked, either intermittently or permanently, in the delivery device 3, at or adjacent the point where the yarn leaves the surface of the delivery device, by means of an edge 10. As shown in FIGS. 1 to 5, the edge 10 is driven with a reciprocating movement which brings it alternately into and out of contact with the yarn 1 between two positions which are shown clearly in FIGS. 4 and 5. If it is desired to obtain a continuous effect over the length of the yarn, the edge 10 is held permanently against the yarn 1, at or adjacent the point where the yarn leaves the surface of the delivery device 3, the pressure exerted by the edge on the yarn being adjusted depending on the materials concerned and the desired effect.

Figure 3:
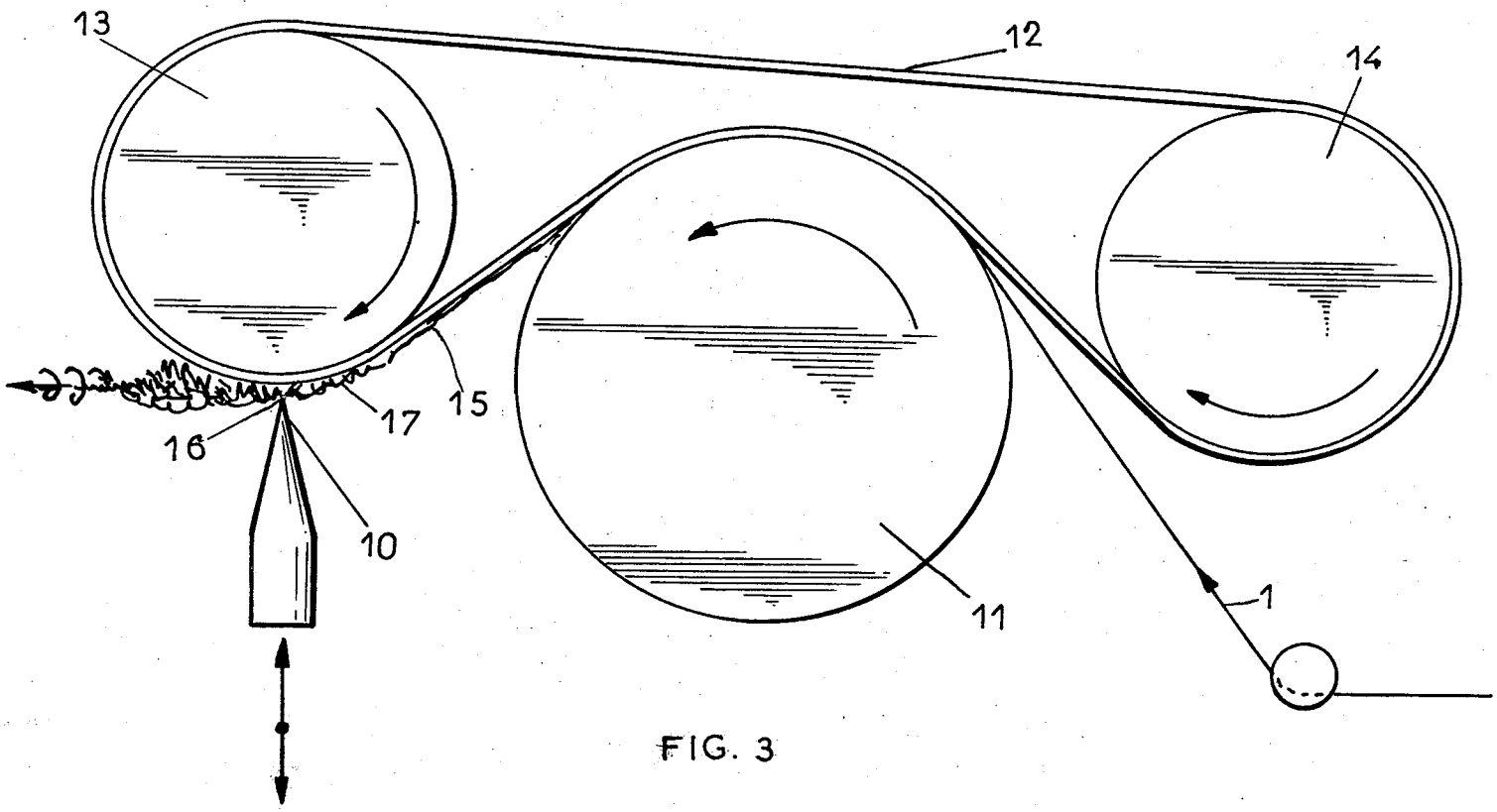
FIG. 3 is an enlarged view showing the formation of the effect when the edge is in contact with the yarn.

Preferably, and as shown in detail in FIG. 3, the invention is carried out using a belt-type delivery device comprising a metal feed shaft 11, in contact with which a belt 12 is held which has a surface which allows some of the filaments to be carried without braking along during the action of the sharp edge 10.

The belt 12 is supported on two shafts 13 and 14 which are slightly set apart from the feed shaft 11. The yarn 1 originating from the feed source 2 passes along a path between the shaft 11 and the belt 12. In order to produce the protuberances the edge 10 is used, for example a sharp edge which comes into and out of contact with the yarn alternately. When the edge 10 is moved away from the yarn (FIG. 5), the twist imparted by the winding-up means extends back essentially to the point 15 (FIG. 3) where the yarn 1 starts to leave the surface of the belt.

When the edge 10 is brought into contact with the yarn (FIGS. 3 and 4), essentially at the point 16 where the yarn finally leaves the surface of the belt 12 some of the filaments 17 are blocked by the edge 10 and there is an accumulation of strands which are blocked from the twist, imparted by the spindle, which extends back to this point.

A temporary accumulation can take place due to flexibility of the edge, this flexibility being achieved by using either an element which is flexible in itself, or by mounting the element carrying the edge on a support which allows a degree of flexibility in the direction of travel of the yarn. In the case where the edge is applied intermittently against the yarn, the protuberances formed are spaced out from one another and possess tapered ends.

In one embodiment of the invention, the edge 10 consists of a blade which is in itself flexible (see FIGS. 4 and 5) and is formed by a metal element of low thickness arranged transversely relative to the travel of the yarn, for example of the razor blade type. The contact time between the said edge 10 and the yarn can vary and is chosen in accordance with the linear speed of the yarn and the size and periodicity of the desired effect.

FIGS. 4 and 5 show, in greater detail, an embodiment which makes it possible to apply the edge 10 intermittently against the yarn 1. In this example, the sharp edge 10 consists of a flexible blade 18, of the razor blade type, mounted on a rigid support 19. This support 19 is moved by the action of a cam 20 acting on a roller 21, controlling a rod 22 which is connected to the support 19. The roller 21 can be held against the cam 20 by any appropriate means, for example, and as illustrated, by means of a spring 23.

Advantageously, when the frame possesses a plurality of stations, a support 19 (see FIG. 2) is used which is common to all the stations, this support being controlled by one or more cams 20 and, preferably, individual blades 18 are used for each station, which makes it easier to replace these blades when they are worn.

The yarn thus obtained according to the invention possesses uniform twisted parts 24 (see FIG. 6), when the edge is not in contact with the yarn, and raised parts or protuberances 25 which are also twisted and are formed by the intertwining and disorientation of part of the filaments of the yarn when the edge is held in contact with the latter.

Optionally, the edge which temporarily blocks some of the filaments can be formed on an element other than a metal blade which in itself possesses a degree of flexibility. Furthermore, as already stated, the said edge can be held permanently against the yarn when it is desired to obtain a continuous effect over the entire length of the yarn.

Possible shapes of elements possessing edges to act on a yarn during its movement are illustrated by FIGS. 7, 8, 9 and 10.

Figure 7:
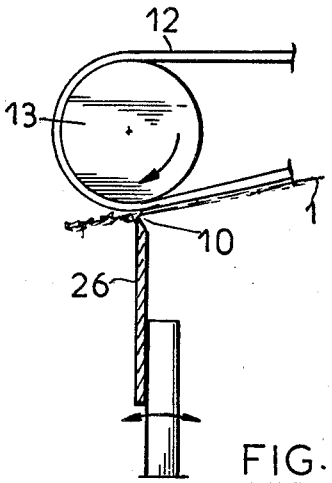

FIG. 7 illustrates an embodiment according to which the edge 10 also consists of a blade 26, made of metal or any other equivalent material, which is mounted on a support, for example made of bakelite, the support providing a slight flexibility in the direction of travel of the yarn 1.

Figure 8:
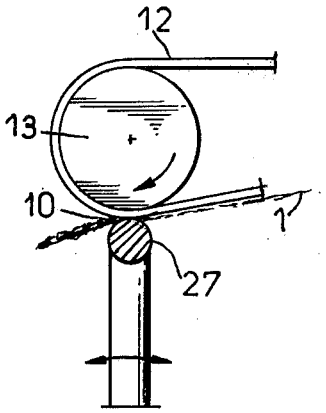

In FIG. 8, the edge 10 is a generatrix of a bar 27 of circular cross-section.

In FIG. 9, the edge 10 consists of one of the sides of a bar 28 of rectangular transverse cross-section.

Finally, FIG. 10 illustrates an embodiment according to which the edge 10 is an edge of a bar of triangular transverse cross-section.

The elements forming the edge which acts on the yarn can be mounted by any appropriate means, such as screws, glue and the like, on a support providing them with a slight flexibility in the direction of travel of the treated yarn.

EXAMPLE 1

Figure 1:
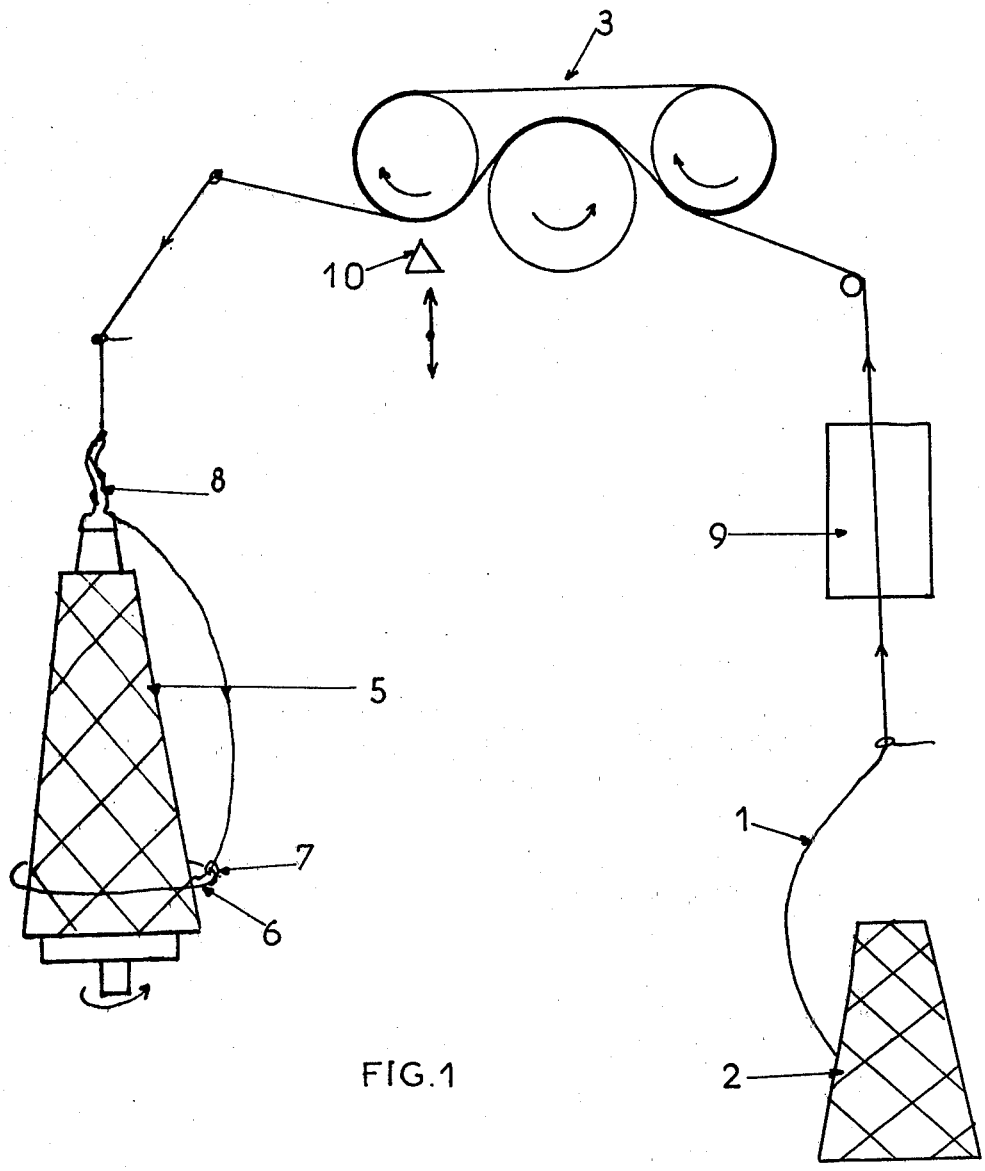
FIG. 1 is a schematic diagram of a device produced according to the invention, providing intermittent action of the edge on the yarn.
Figure 2:
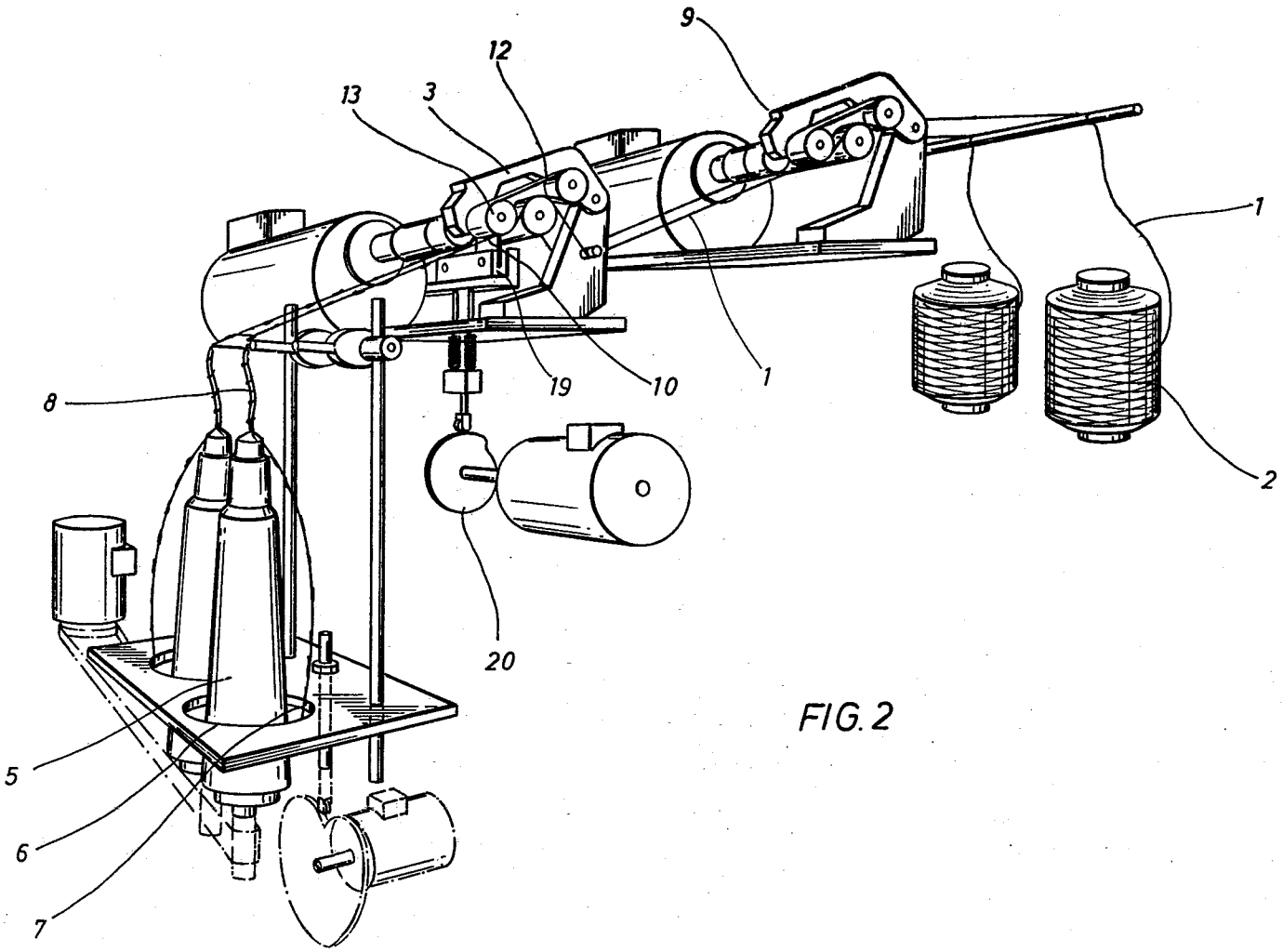
FIG. 2 is a schematic perspective view of a frame including a device according to the invention, also having intermittent action of the edge on the yarn.

Using the device illustrated in the attached drawings, and more particularly in FIG. 2, a fancy yarn possessing protuberances is produced using, as the starting material, a 145 dtex polyester yarn, having thirty-four strands, which has been texturised beforehand by false twisting.

The yarn used is texturised in a conventional manner on a A.R.C.T.F.T. type false twist machine.

The speed of rotation of the false twist spindle is 210,000 revolutions per minute.

The extent of false twist is 1,800 turns per meter.

The setting-in temperature is 200° C.

The feed into the texturising oven is carried out so as to have a shrinkage of 2%.

Linear speed during the false twist treatments is 107 meters per minute.

The texturised yarn thus obtained which, it must be noted, was virtually free from twist other than the twist obtained during its production was to a device of the type illustrated by FIG. 2, the operation of which is shown in detail in FIGS. 1, 3, 4 and 5.

Before passing into the delivery device 3, the yarn 1, which originates from the feed source 2 consisting of a bobbin held on the false twist frame, is subjected, by means of the delivery device 9 or any other appropriate means, to a pulling force which makes it possible to develop the crimp. This pulling force is about 130 grams.

The delivery device 3 positively delivers the yarn at a constant speed of 20 meters per minute, and the winding-up twist imparted by the spindle, which has a ring and traveller 6 and 7 and possesses a pointed head 8, is 238 turns per meter as an S twist.

Some of the filaments constituting the yarn 1 are temporarily and intermittently braked in the region of the second roller 13 carrying the belt 12 of the delivery device, and this braking takes place at the point at which the yarn leaves the delivery device.

The braking of some of the filaments is achieved by means of the sharp metal edge 10 essentially consisting of a blade 18 which is similar to a razor blade and is mounted in the support 19. The control of this edge and its application against the yarn 1 are achieved in the manner illustrated in greater detail by FIGS. 4 and 5.

The edge 10 is applied to the yarn 1 for a duration of 0.6 seconds, the interval between two applications being 0.7 seconds. When the edge is in contact with the yarn 1, some of the filaments are braked and there is an accumulation which, because of the flexibility of the edge in the direction of travel of the yarn, intermittently escapes and is caught by the twist, imparted by the spindle, which extends back to the point of application of the edge.

The yarn obtained, illustrated in FIG. 6, which shows various portions taken along the length of this yarn, possesses uniform twisted zones 24 and protuberances 25 which are also twisted and have tapered ends.

The effects formed by the protuberances 25 are perfectly stable and have no tendency to slide along the yarn, and the yarn can be woven or knitted easily.

EXAMPLE 2

Example 1 is repeated, the only difference being that the deliver device 3, which is arranged in front of the winding-up and twisting device, is fed with two yarns in parallel, the one being a polyester yarn identical to that of Example 1, and the other being a 110 dtex polyamide 6,6 yarn which has 34 strands and has also been texturised by false twist in the conventional manner. Both these yarns are virtually free from twist other than that obtained during their production, which twist is of the order of 20 turns per meter.

Before passage into the delivery device 3, the crimp of the polyester yarn is developed by placing it under tension in the same manner as in Example 1, and that of the polyamide yarn is developed by subjecting it to a tension of 100 grams.

The yarns are subjected to the action of the sharp edge in the same way as in Example 1.

As previously, the yarns obtained possess uniform twisted zones and protuberances which are also twisted and have tapered ends; furthermore, it is found that the two feed yarns are intimately mixed and form a single yarn.

Furthermore, the effects are perfectly stable and, because of the mixing of the material constituting the yarns, it is possible to obtain dyeing effects.

EXAMPLE 3

A fancy yarn according to the invention is produced, but, in this example, the edge 10 is applied permanently against the yarn 1 and at the point where the yarn leaves the surface of the delivery device. In this Example, the edge used is a sharp edge, such as that shown in FIG. 7, and consists of a metal blade 26 which is mounted on a fixed support and provides a degree of flexibility in the forward direction. A device otherwise similar to that illustrated by FIG. 2 is used except that in this case the edge 10 is not subjected to the action of the cam 20, the edge support being mounted integral with the frame. In this example, the delivery device 3 is fed with two yarns in parallel, these two yarns being identical and based on polyamide 6,6, having a gauge of 330 dtex and each possessing 92 strands. Prior to their treatment according to the invention, these yarns were subjected to a conventional false twist treatment and, before passage into the delivery device 3, the crimp is developed by subjecting them to a tension of about 100 grams.

The speed of the delivery device 3 is 10 meters per minute and the speed of the ring-and-traveller winding-up spindle is 6,100 revolutions per minute.

The edge 10 causes a temporary braking of the filaments and the yarn obtained is shown in FIG. 11. As can be seen in this figure, the yarn possesses, relative to the starting yarn, a continuous protuberance over its entire length, giving it an appearance of fibrous spun yarn.

EXAMPLE 4

In this Example, the delivery device 3 is fed with two 330 dtex polyamide 6,6 yarns having 92 strands and texturised by false twist. Before passage into the delivery device 3, the crimp is developed by placing them under tension as in the preceding Example.

Furthermore, a 310 dtex elasthane yarn, marketed under the trademark Lycra, is brought, under tension, to the entry of the delivery device 3.

The speed of the delivery device 3 is 11 meters per minute and the winding-up speed of the ring-and-traveller spindle is 3,900 revolutions per minute.

As previously, an edge 10 is applied to the yarns passing into the delivery device 3, essentially at the point where these yarns leave the surface of the delivery device. As in the preceding Example 3, this edge is applied permanently against the said yarns.

An elastic yarn is obtained which possesses a plurality of protuberances 72 (see FIG. 12) and the Lycra yarn is embedded in the middle of the other two constituents.

EXAMPLE 5

Example 1 is repeated, but the edge 10, consisting of a metal blade, is replaced by a cylindrical flexion bar such as that shown in FIG. 8, this bar being ceramic and having a diameter of 5 millimeters. The frequency of application of the bar and the duration of this application are identical to those of Example 1.

In this case, the edge 10 is a generatrix of the bar.

The yarn obtained is virtually the same as that of Example 1 and possesses, over its entire length, stable protuberances which are spaced out from one another.

EXAMPLE 6

Example 2 is repeated, the edge used in this example consisting of one face of a bar 28, such as that illustrated in FIG. 9, which has a rectangular transverse cross-section. As in Example 2, the edge is applied intermittently against the yarn 1.

The yarn obtained is virtually the same as that of Example 2.

The preceding Examples clearly show the advantages gained by the invention and, in particular, they show that it is possible to obtain, simply and economically, a very wide variety of fancy yarns possessing stable effects over their lengths. It is obvious that the invention is not limited to the Examples described above, but that it also encompasses all variants.

We claim:

1. A process for the production of a fancy yarn having stable protuberances along its length, wherein at least one multi-filament yarn of continuous filaments which is essentially free from twist is delivered by means of a positive delivery device and then twisted and taken up by means of a spindle, and wherein, without varying the feed rate and the take-up speed of the yarn, some of the filaments of the multi-filament yarn are temporarily braked by means of an edge acting on the yarn at a position where the yarn is in contact with a surface of the delivery device, the twist imparted by the spindle extending back to the zone in which the edge acts on the yarn.

2. A process according to claim 1, wherein the treated multi-filament yarn is a yarn which has been texturised by false twist.

3. A process according to claim 1, wherein the braking of some of the filaments of the multi-filament yarn is carried out intermittently.

4. A process according to claim 3, wherein the frequency and the duration of the braking are varied.

5. A process according to claim 1, wherein the braking of some of the filaments of the multi-filament yarn is carried out continuously.

6. A process according to claim 1, wherein the yarn is under tension upstream of the delivery device.

7. A device for production of a fancy yarn having stable protuberances along its length from one or more multi-filament yarns of continuous filaments, such device comprising at least one working station and, at each working station, at least one positive yarn delivery device having a surface, a spindle for twisting and taking up the yarn arranged downstream from said delivery device, and an edge for temporarily braking some of the filaments, said edge being positioned to act on the yarn whilst the yarn is in contact with said surface of the delivery device, such that in use the twist imparted by the spindle extends back to the zone in which the edge acts on the yarn.

8. A device according to claim 7, including means upstream of said edge effective to place the yarn under tension.

9. A device according to claim 8, wherein said means for placing the yarn under tension comprises a second positive delivery device.

10. A device according to claim 7 wherein said edge is a sharp edge of a blade.

11. A device according to claim 10, wherein said blade is flexible in the direction of travel of the yarn, and including a rigid support on which the blade is mounted.

12. A device according to claim 10, wherein said blade is rigid and including a support on which said blade is mounted and which provides flexibility in the direction of travel of the yarn.

13. A device according to claim 7, wherein said edge is a generatrix of a bar of circular cross-section.

14. A device according to claim 7, wherein said edge is a face of a bar of rectangular transverse cross-section.

15. A device according to claim 7 and further comprising means to reciprocate and edge into and out of contact with the yarn in a manner which is adjustable as to the frequency and duration of temporary braking.

16. A device according to claim 7, including means fixing said edge to be in permanent contact with the yarn during use.

17. A device according to claim 7, wherein said yarn delivery device which has the said surface has a flexible coating, the surface condition of which allows some filaments to be carried along unimpeded and the other filaments to be temporarily braked when the edge acts on the yarn.

18. A device according to claim 7, wherein the yarn delivery device is a belt-type delivery device and comprises a metal drive shaft, a belt contacted by said drive shaft and two guide rollers supporting said belt, guide-rollers, a yarn path defined between said belt and said drive shaft, and the edge being arranged adjacent the point where in use, the yarn leaves the surface of the belt.

19. A device according to claim 7, wherein said delivery device is a roller-type delivery device and comprises a metal drive cylinder, and a rubber pressure cylinder, the edge being located adjacent the point where in use, the yarn leaves the surface of the said pressure cylinder.

20. A device according to claim 7, wherein said spindle is of the ring-and-traveller type having a pointed head.

21. A device for production of a fancy yarn having stable protuberances along its length from one or more multi-filament yarns of continuous filaments, such device comprising a first positive delivery device, a second, downstream, positive belt-type delivery device, means for controlling the said delivery devices in a predetermined speed ratio, an edge for temporarily braking some of the filaments, and associated with the second delivery device, said edge possessing flexibility in the direction of movement of the yarn and being arranged to act at least temporarily on the yarn whilst the yarn is in contact with a surface of the second delivery device adjacent the point where, in use, the said yarn leaves the second delivery device, and a ring and traveller spindle with a pointed head for winding-up and twisting the yarn thus treated and arranged downstream from the second positive delivery device, so that in use the twist imparted by the spindle extends back to the edge.

22. A fancy yarn possessing stable protuberances spaced along its length and obtained by a process according to claim 1 and formed from at least one continuous multi-filament yarn which is twisted and possesses, along its length protuberances which are formed as a result of disorientation and intertwining of filaments, the said protuberances also being twisted and being progressively joined to uniform parts of the yarn and with their ends tapered.

* * * * *